US007809150B2

(12) United States Patent
Natarajan et al.

(10) Patent No.: US 7,809,150 B2
(45) Date of Patent: Oct. 5, 2010

(54) METHOD AND APPARATUS TO REDUCE ENTRAINMENT-RELATED ARTIFACTS FOR HEARING ASSISTANCE SYSTEMS

(75) Inventors: Harikrishna P. Natarajan, Shakopee, MN (US); Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1258 days.

(21) Appl. No.: 10/857,599

(22) Filed: May 27, 2004

(65) Prior Publication Data

US 2005/0036632 A1 Feb. 17, 2005

Related U.S. Application Data

(60) Provisional application No. 60/473,844, filed on May 27, 2003.

(51) Int. Cl.
*H04R 25/00* (2006.01)

(52) U.S. Cl. ..... 381/318; 381/93; 381/71.11

(58) Field of Classification Search ..... 381/58–60, 381/95, 96, 83, 93, 317, 318, 71.11, 71.12, 381/108

See application file for complete search history.

(56) References Cited

U.S. PATENT DOCUMENTS

| | | | | |
|---|---|---|---|---|
| 3,601,549 | A | 8/1971 | Mitchell | |
| 4,731,850 | A | 3/1988 | Levitt et al. | |
| 4,783,817 | A | 11/1988 | Hamada et al. | |
| 4,879,749 | A | 11/1989 | Levitt et al. | |
| 5,016,280 | A | 5/1991 | Engebretson et al. | |
| 5,502,869 | A | 4/1996 | Smith et al. | |
| 5,533,120 | A | 7/1996 | Staudacher | |
| 5,619,580 | A * | 4/1997 | Hansen | 381/314 |
| 5,621,802 | A | 4/1997 | Harjani et al. | |
| 5,668,747 | A * | 9/1997 | Ohashi | 708/322 |
| 6,173,063 | B1 | 1/2001 | Melanson | |
| 6,389,440 | B1 * | 5/2002 | Lewis et al. | 708/322 |
| 6,434,247 | B1 * | 8/2002 | Kates et al. | 381/312 |
| 6,480,610 | B1 | 11/2002 | Fang et al. | |
| 6,552,446 | B1 | 4/2003 | Lomba et al. | |

(Continued)

FOREIGN PATENT DOCUMENTS

| | | |
|---|---|---|
| DE | 19748079 | 5/1999 |

(Continued)

OTHER PUBLICATIONS

Maxwell, J. A., et al., "Reducing acoustic feedback in hearing aids", *IEEE Transactions on Speech and Audio Processing*, 3(4), (Jul. 1995),304-313.

(Continued)

*Primary Examiner*—Vivian Chin
*Assistant Examiner*—Jason R Kurr
(74) *Attorney, Agent, or Firm*—Schwegman, Lundberg & Woessner, P.A.

(57) ABSTRACT

A system providing method and apparatus to detect occurrence of an entrainment artifact and address it. The system analyzing a feedback canceller filter for certain characteristics that are associated with an entrained filter. When an entrained filter is detected, the feedback canceller filter is reset to a good filter that ideally represents the current approximate external acoustic feedback path without the characteristics of the entraining signal.

22 Claims, 7 Drawing Sheets

U.S. PATENT DOCUMENTS

| | | | | |
|---|---|---|---|---|
| 7,058,182 | B2 * | 6/2006 | Kates | 381/60 |
| 7,519,193 | B2 | 4/2009 | Fretz | |
| 2003/0026442 | A1 | 2/2003 | Fang et al. | |
| 2005/0047620 | A1 | 3/2005 | Fretz | |
| 2007/0223755 | A1 | 9/2007 | Salvetti et al. | |
| 2009/0175474 | A1 | 7/2009 | Salvetti et al. | |

FOREIGN PATENT DOCUMENTS

| | | | |
|---|---|---|---|
| EP | 1718110 | A1 | 2/2006 |
| WO | WO-0106746 | A2 | 1/2001 |
| WO | WO-2004105430 | A1 | 12/2004 |

OTHER PUBLICATIONS

Rife, D., "Transfer-function measurement with maximum length sequences", *J. Audio Eno. Soc.*, 37(6), (1989),419-444.

"European Application Serial No. 07250899.7, European Search Report mailed May 15, 2008", 7 pgs.

"European Application Serial No. 07250899.7, Office Action Mailed Jan. 15, 2009", 1 pgs.

"Advance Adaptive Feedback Cancellation", *IntriCon: Technology White Paper*, [Online]. Retrieved from the Internet: <URL:http://www.intricondownloads.com/D1/techdemo/WP_Advanced_AFC_rev101006.pdf>, (Oct. 10, 2005), 3 pgs.

"Entrainment (Physics)", [Online]. Retrieved from the Internet: <URL:http://en.wikipedia.org/w/index.php?title=Entrainment_(physics)&printable=yes>, (Apr. 25, 2009), 2 pgs.

"Inspiria Ultimate—GA3285", [Online]. Retrieved from the Internet: <URL:http://www.sounddesigntechnologies.com/products_InspiriaUltimate.php>, (Jun. 18, 2009), 4 pgs.

"U.S. Appl. No. 11/276,763 Non-Final Office Action mailed Apr. 2, 2010", 11 Pgs.

"U.S. Appl. No. 11/276,763, response filed Jan. 11, 2010 to Restriction Requirement mailed Dec. 10, 2009", 9 Pgs.

"U.S. Appl. No. 11/276,763, Restriction Requirement Received Dec. 10, 2009", 6 pgs.

"European Application Serial No. 07250899.7, Response to Official Communication Filed Jul. 13, 2009", 17 pgs.

* cited by examiner

METHOD AND APPARATUS TO REDUCE ENTRAINMENT-RELATED ARTIFACTS FOR HEARING ASSISTANCE SYSTEMS

CLAIM OF PRIORITY AND RELATED APPLICATION

This application claims the benefit under 35 U.S.C. 119(e) of U.S. Provisional Patent Application Ser. No. 60/473,844, filed May 27, 2003, the entire disclosure of which is hereby incorporated by reference in its entirety.

FIELD OF THE INVENTION

The present subject matter relates generally to adaptive filters and in particular to method and apparatus to reduce entrainment-related artifacts for hearing assistance systems.

BACKGROUND

Digital hearing aids with an adaptive feedback canceller usually suffer from artifacts when the input audio signal to the microphone is periodic. The feedback canceller may use an adaptive technique, such as a N-LMS algorithm, that exploits the correlation between the microphone signal and the delayed receiver signal to update a feedback canceller filter to model the external acoustic feedback. A periodic input signal results in an additional correlation between the receiver and the microphone signals. The adaptive feedback canceller cannot differentiate this undesired correlation from that due to the external acoustic feedback and borrows characteristics of the periodic signal in trying to trace this undesired correlation. This results in artifacts, called entrainment artifacts, due to non-optimal feedback cancellation. The entrainment-causing periodic input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, instrumental music to name a few. These artifacts, in addition to being annoying, can result in reduced output signal quality. Thus, there is a need in the art for method and apparatus to reduce the occurrence of these artifacts and hence provide improved quality and performance.

SUMMARY

The present system provides method and apparatus to address the foregoing needs and additional needs not stated herein. In one embodiment, the system provides method and apparatus to detect occurrence of an entrainment artifact and address it before it could become uncomfortable to the hearing aid user. In one embodiment, the system analyzes the feedback canceller filter for certain characteristics that are associated with an entrained filter. When an entrained filter is detected, the feedback canceller filter is reset to a good filter that ideally represents the current approximate external acoustic feedback path without the characteristics of the entraining signal.

Other embodiments and aspects of embodiments are provided which are not summarized here. This Summary is an overview of some of the teachings of the present application and not intended to be an exclusive or exhaustive treatment of the present subject matter. Further details about the present subject matter are found in the detailed description and appended claims. Other aspects of the invention will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the spirit and scope of the present invention. The following detailed description provides examples, and the scope of the present invention is defined by the appended claims and their equivalents.

It should be noted that references to "an", "one", or "various" embodiments in this disclosure are not necessarily to the same embodiment, and such references contemplate more than one embodiment.

Figure 1:
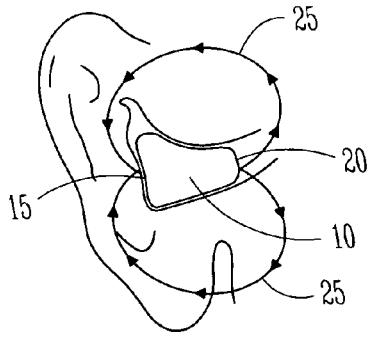
FIG. 1 is a diagram demonstrating, for example, an acoustic feedback path for one application of the present system relating to an in the ear hearing aid application, according to one application of the present system.

FIG. 1 is a diagram demonstrating, for example, an acoustic feedback path for one application of the present system relating to an in-the-ear hearing aid application, according to one application of the present system. In this example, a hearing aid 10 includes a microphone 15 and a receiver 20.

The sounds picked up by microphone 15 are processed and transmitted as audio signals by receiver 20. The hearing aid has an acoustic feedback path 25 which provides audio from the receiver 20 to the microphone 15.

Figure 2:
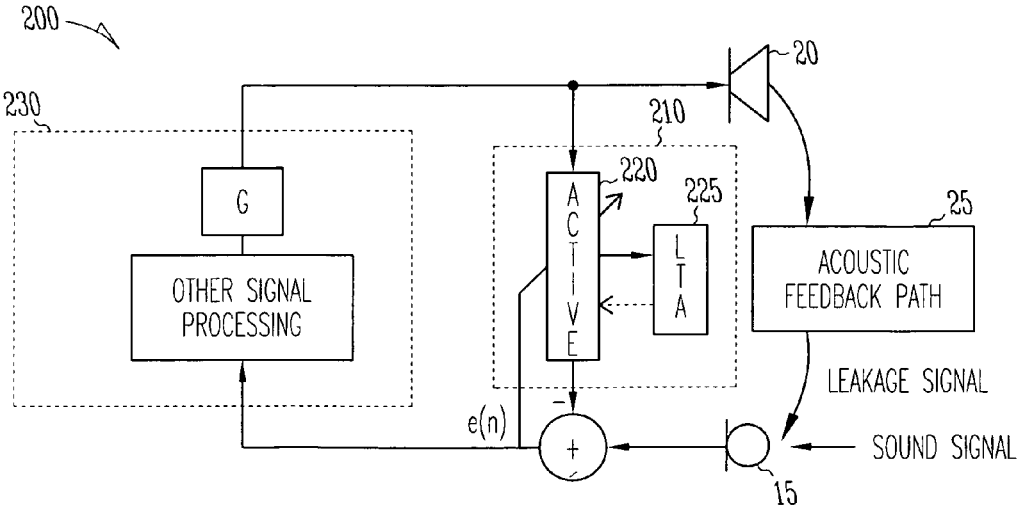
FIG. 2 is a diagram demonstrating one example of a hearing system having an acoustic feedback path and an estimate leakage signal modeled as a feedback canceller filter, according to one embodiment of the present system.

In systems with adaptive filters, FIG. 2 is a diagram demonstrating one example of a hearing assistance system 200 having an acoustic feedback path 25 and an estimated leakage signal modeled as a feedback canceller filter 210, according to one embodiment of the present system. In one example the feedback canceller filter 210 includes an active filter 220 and a long term average filter (LTA) 225. The correlation between the output signal and the leakage signal (acoustic feedback path) is used to remove the leakage signal from the sound signal at the microphone 15. Signal processing electronics 230 are used to amplify and process the acoustic signal in its electronic form.

In one embodiment, the system provides method and apparatus to detect occurrence of an entrainment artifact and address it before it could become uncomfortable to the hearing aid user. In one embodiment, the system analyzes the feedback canceller filter 210 for certain characteristics that are associated with an entrained filter. When an entrained filter is detected, the feedback canceller filter 210 is reset to a good filter that ideally represents the current approximate external acoustic feedback path without the characteristics of the entraining signal.

Figure 3:
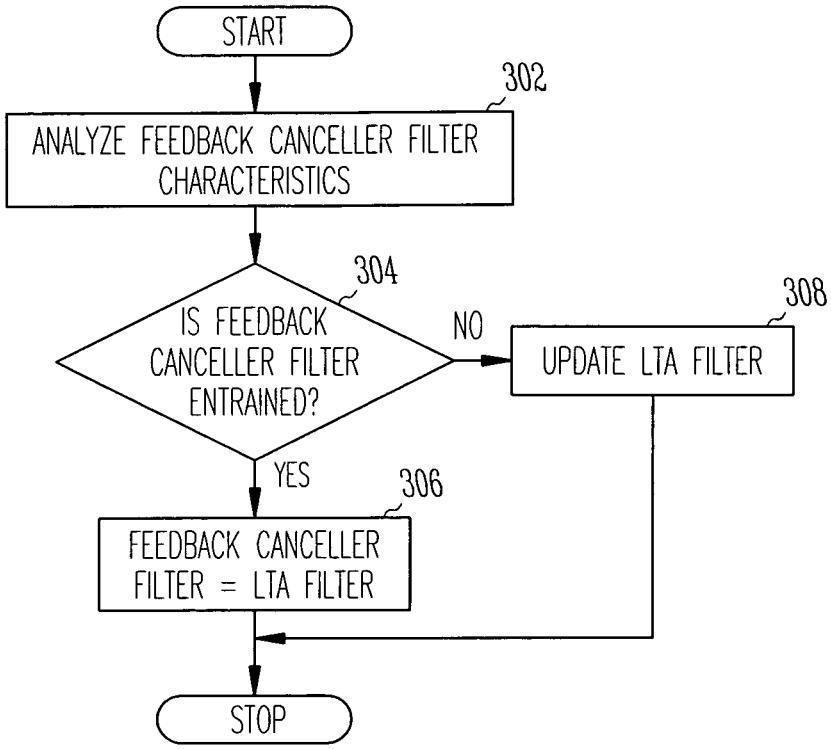
FIG. 3 is a flow diagram of one embodiment of a system for reducing entrainment-related artifacts according to one embodiment of the present system.

In one embodiment demonstrated by FIG. 3, the system includes two stages:

Stage 1: Detect Entrainment Artifacts

In one embodiment, the system analyzes certain characteristics of the feedback canceller filter to determine if it is entrained (302). The analyzed characteristics include, but are not limited to, normalized DC Bias measure, ratio of the end-coefficient power estimate to the center-coefficient power estimate, number of slope transitions and a correlation estimate. These are compared to pre-defined thresholds to detect possible entrainment artifacts (304).

Stage 2: Post Entrainment detection

In one embodiment, when an entrainment is detected the feedback canceller filter is reset to a good filter (306). In one example, the good filter is a long time average of the feedback canceller filter 210, called the Long Term Average (LTA) filter 225, which would represent the current external feedback path but would not be affected by the short-time entrainment. This reset stops the entrainment artifacts before they can become noticeable and uncomfortable to the listener. The LTA filter 225 is not updated when entrainment is detected to keep it free from entrainment characteristics at all times (308).

Figure 4:
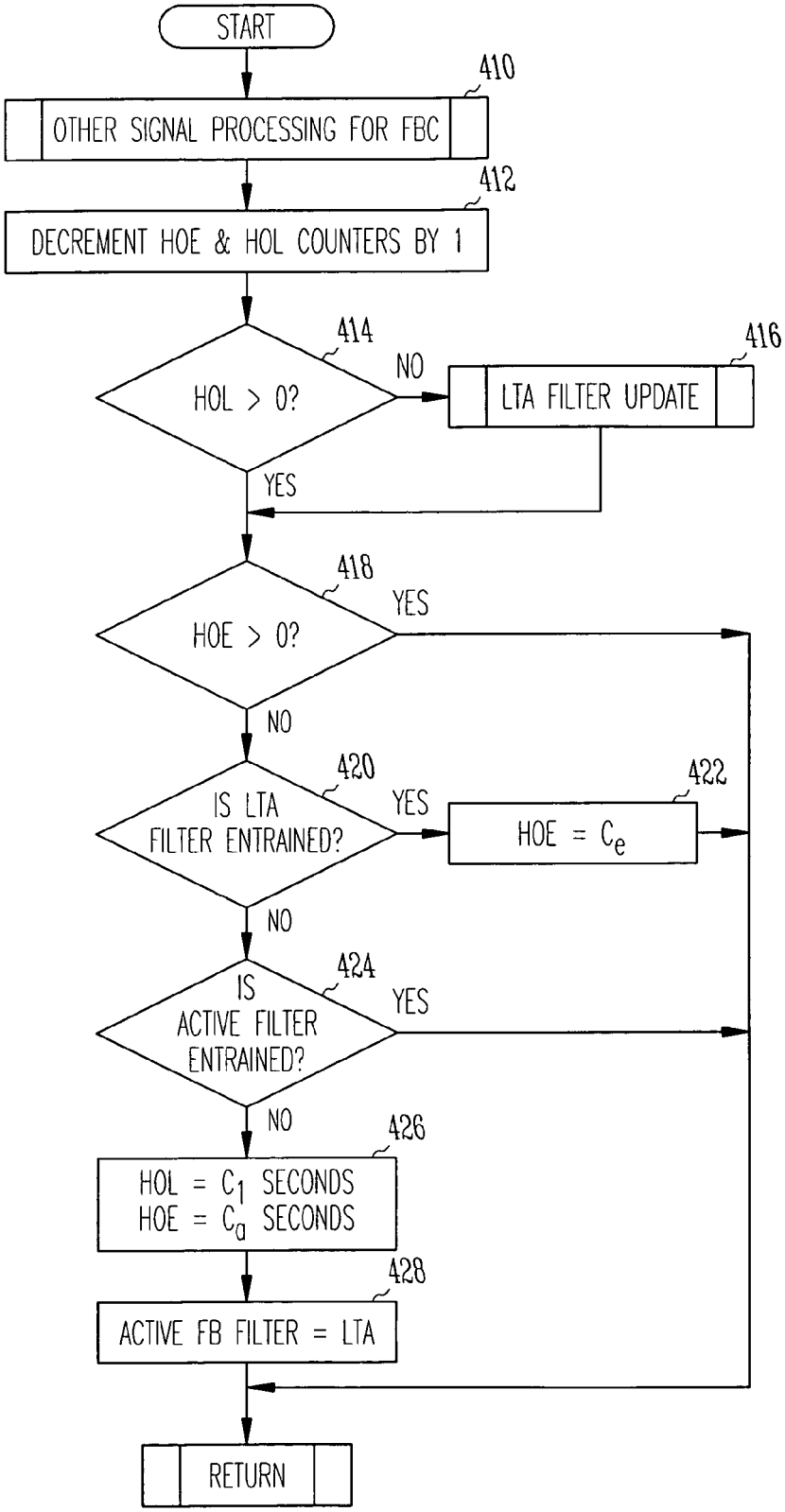
FIG. 4 is a flow diagram showing one embodiment of a system for reducing entrainment-related artifacts according to one embodiment of the present system.

FIG. 4 is a flow diagram showing a more detailed approach of one example of a system for reducing entrainment-related artifacts according to one embodiment of the present system. The flow diagram shows one example of how HOE (hold off entrainment) and HOL (hold off LTA) are decremental counters used to control the entrainment reduction technique and the LTA filter update for improved performance. In this embodiment, the system performs other signal processing for feedback cancellation (410) while managing the HOE and HOL counters. After the processing (410) is performed, the HOE and HOL counters are decremented (412). Once detecting whether the HOL is equal to or less than zero (414), the LTA filter 225 is updated (416). If the HOL remains greater than zero the HOE is tested (418) to see if it is greater than zero. If so, the system bypasses LTA and Active Filter entrainment testing and the system completes this pass of testing. If the HOE is equal to or less than zero, then the system checks the LTA Filter 225 for possible entrainment (420) via a detection process (500 of FIG. 5), which is discussed in further detail herein. If the LTA filter 225 is entrained, then HOE is set to Ce (422) and the system completes this pass of testing. This provides the entrained LTA filter time (at least Ce passes of the loop) to become "unentrained". If the LTA filter 225 is not entrained, then the system checks to see if the Active Filter 220 is entrained (424) via a detection process (500 of FIG. 5). If the Active Filter 220 is not entrained, then the system completes this pass of testing. If the Active Filter 220 is entrained, then the system sets HOL to C1 seconds and HOE to Ca seconds (426) and the Active Filter 220 is set to the LTA Filter (428) to approximate a model of the acoustic path without the entrainment artifacts (recall that in this state the LTA Filter 225 is not entrained due to the previous testing (420)). Those of skill in the art upon reading and understanding the foregoing will appreciate that other variations of this process are possible without departing from the scope of the present teachings. For example, some changes in the order and character of the variables may be employed without departing from the present teachings.

Figure 5:
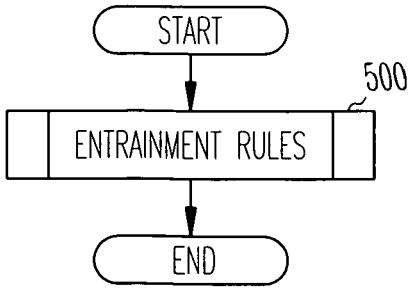
FIG. 5 is a flow diagram of entrainment detection according to one embodiment of the present system.

FIG. 5 is a flow diagram of entrainment detection according to one embodiment of the present system. It is understood that in one embodiment the same entrainment detection approach is employed for different filters. For example, the entrainment rules (500) applied for testing the LTA Filter 225 are the same or similar to those for testing the Active Filter 220. In varying embodiments, different entrainment detection approaches may be employed for different filters. For example, a first set of entrainment rules is applied for testing the LTA Filter 225 and a second set of entrainment rules are applied for testing the Active Filter 220. Thus, the flow chart provided herein is intended to demonstrate an example of the system and is not intended to be exhaustive or limiting of the present subject matter.

Figure 6:
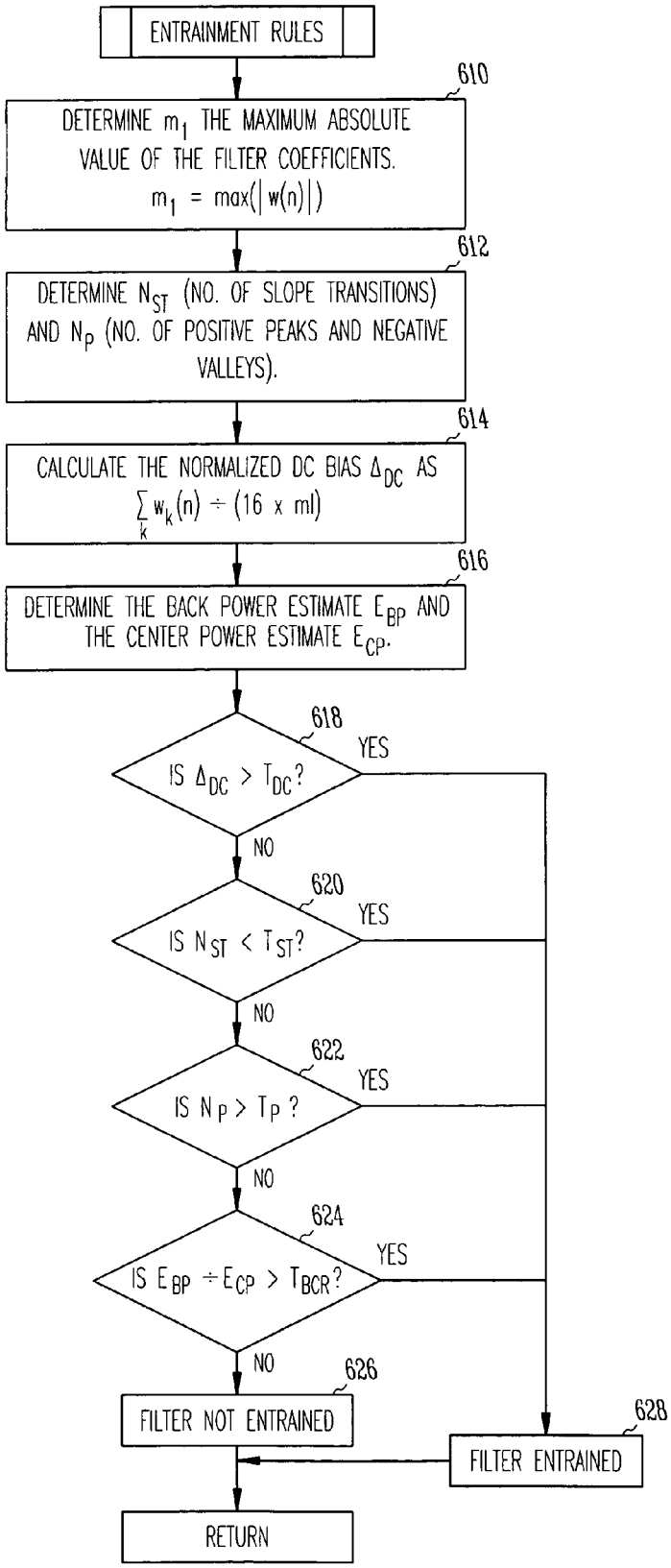
FIG. 6 is a detailed flow diagram of entrainment detection according to one embodiment of the present system.

FIG. 6 is a detailed flow diagram of entrainment detection according to one embodiment of the present system. In one application, the process of FIG. 6 is used in FIGS. 4 and 5 to detect entrainment of one or more filters, including, but not limited to, the LTA Filter 225 and the Active Filter 220. It is understood that the same or different entrainment detection approaches and parameters may be employed for different filters in varying embodiments without departing from the present teachings. The following abbreviations are used in FIG. 6:

$T_{DC}$-Threshold for Normalized DC Bias Rule, $T_{ST}$-Threshold for Number of Slope Transitions, $T_P$-Threshold for Number of positive peaks & Negative valleys, and $T_{BCR}$-Threshold for Back power estimate to Center power estimate ratio.

One embodiment of the detection of entrainment is as follows: The process includes a determination of $m_1$ the maximum absolute value of filter coefficients to determine, at least in part, if the filter is entrained (610). The process includes detection of the number of slope transitions Nst and the number of positive peaks and valleys Np (612). The process includes calculation of the normalized DC Bias measure (614). The process includes a determination of back power estimates Ebp and center power estimate Ecp (616). In varying embodiments and combinations, these tests can be combined to determine if the filter is entrained (628) or not entrained (626).

In one embodiment, a "score" is assigned to different results from different tests to determine whether the filter is entrained using a scale. In such embodiments, the "scores"

can be used independently or added to create an overall figure of merit to determine how likely the filter is to be entrained. Other testing embodiments are possible without departing from the present teachings.

It is understood that one of skill in the art, upon reading and understanding this description will appreciate that several variations of order and individual processes are employed in varying embodiments without departing from the scope of the present system.

LTA Filter Update:

In one embodiment, the LTA Filter 225 is updated once every few milliseconds by averaging the feedback canceller filter over a reasonably long duration. For example, assume that the LTA Filter 225 is a 16 tap filter. The 16-tap Long Term Average (LTA) filter ($wl_k(n)$) is updated, once every few milliseconds, by averaging the feedback canceller filter ($w_k(n)$) over a reasonably long duration ($\tau_L$).

$$wl_k(n) = \sum_{m=1}^{\tau_L} w_k(n-m), \quad k = 0, 1, \ldots, 15$$

Correlation as an Entrainment Rule:

In one embodiment, correlation is used as an entrainment rule. A 'good' feedback canceller filter accurately portrays the acoustic feedback and does not have any characteristics associated with the input sound signal. Since the filter is literally independent of the input signal, the correlation between the feedback filter and the input signal is very low.

In an entrainment scenario, the entrained filter starts to look more like the input sound signal. So the correlation between the filter and the sound signal is high. This characteristic is used to detect an entrained filter in one embodiment.

The rule calculates the correlation coefficient between the input signal and the filter and compares it to a pre-determined threshold. If the correlation coefficient is greater than the threshold, the filter is detected as being entrained else it is termed as being a good filter.

The following FIG. 7-11 show different feedback canceller filter profiles and some of the characteristics detected on those exhibiting entrainment to demonstrate the operation of the present system. These are intended as examples, and not to be considered in an exclusive or limiting sense.

Figure 7:
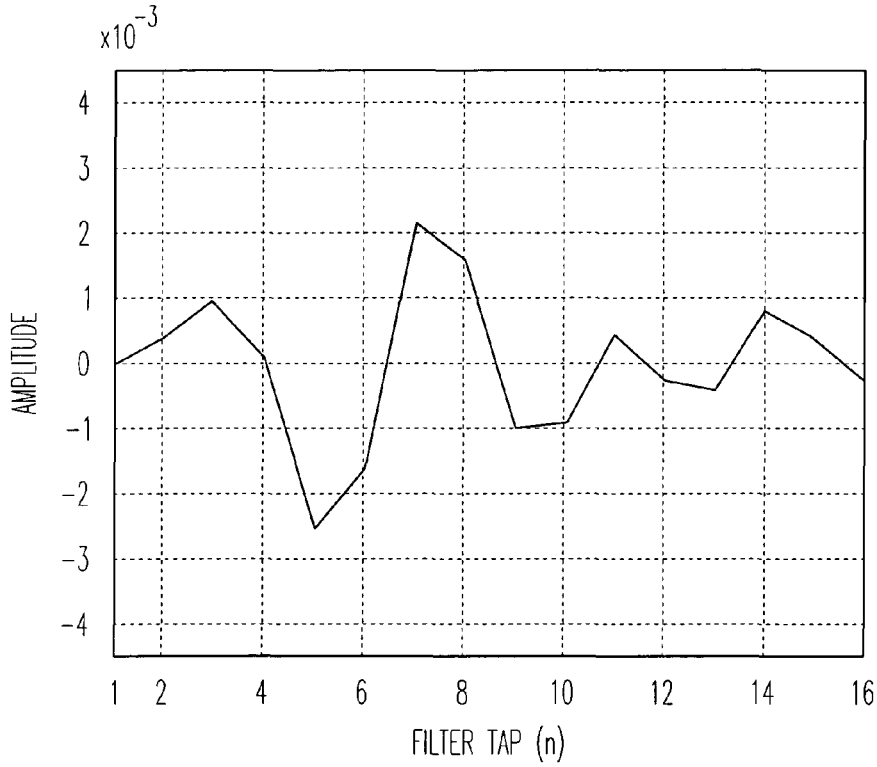
FIG. 7 is an example of a good feedback canceller filter profile that represents an external acoustic feedback path according to one embodiment of the present system.

FIG. 7 is an example of a good feedback canceller filter profile that represents an external acoustic feedback path according to one embodiment of the present system. The profile exhibits low DC bias (symmetric around zero), high energy in the center coefficients (e.g., $5^{th}$-$10^{th}$ tap) and low back coefficient energy (e.g., $12^{th}$-$16^{th}$ tap). The profile also exhibits a moderate number of slope transitions, since the peaks and valleys are about seven (7) in this example. The profile also exhibits low correlation with the input sound signal.

Figure 8:
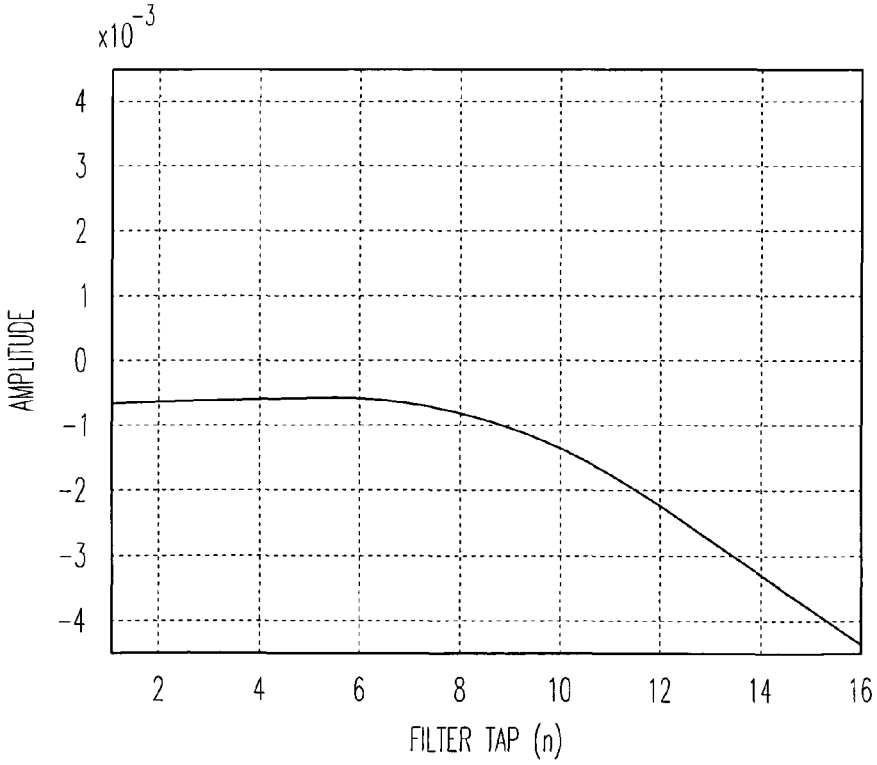
FIG. 8 is an example of an entrained feedback canceller filter profile, and in this case, due to a 300 Hz tone input signal.

FIG. 8 is an example of an entrained feedback canceller filter profile, and in this case, due to a 300 Hz tone input signal. The filter no longer represents the acoustic feedback path accurately and acquires the characteristics of the input signal, such as non-symmetric pattern around zero and hence a high DC bias. This high DC bias is detected by the normalized DC bias rule and the entrained filter is reset to the good filter.

Figure 9:
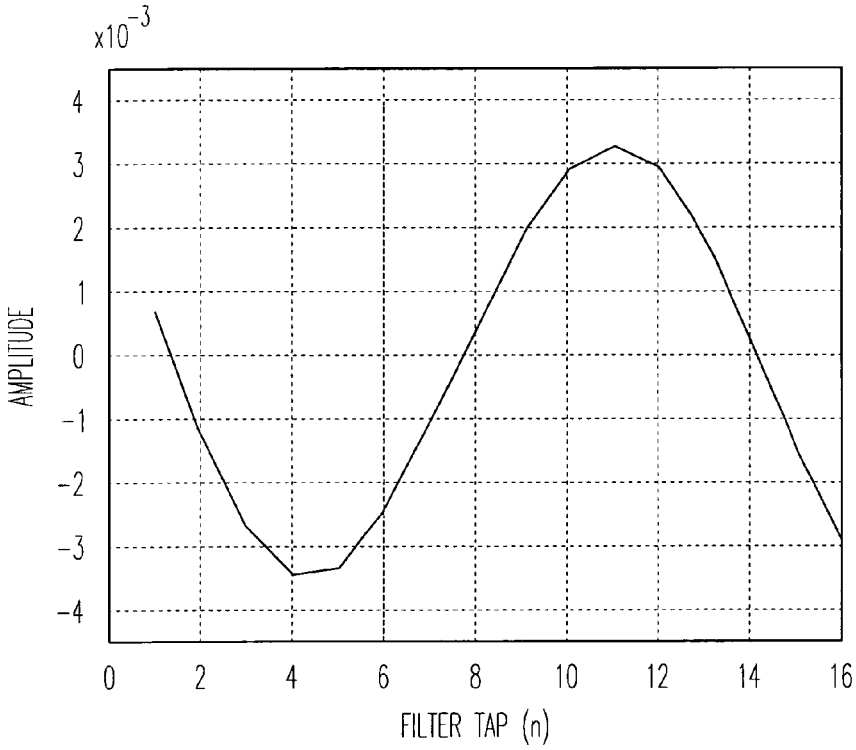
FIG. 9 is an example of an entrained feedback canceller filter profile, and in this case, due to a 1300 Hz tone input signal.

FIG. 9 is an example of an entrained feedback canceller filter profile, and in this case, due to a 1300 Hz tone input signal. The filter no longer represents the acoustic feedback path accurately and acquires the characteristics of the input signal. The filter profile depicts a reduced number of slope transitions (e.g., 2). This character is detected by the slope transition rule and the entrained filter is reset to the good filter.

Figure 10:
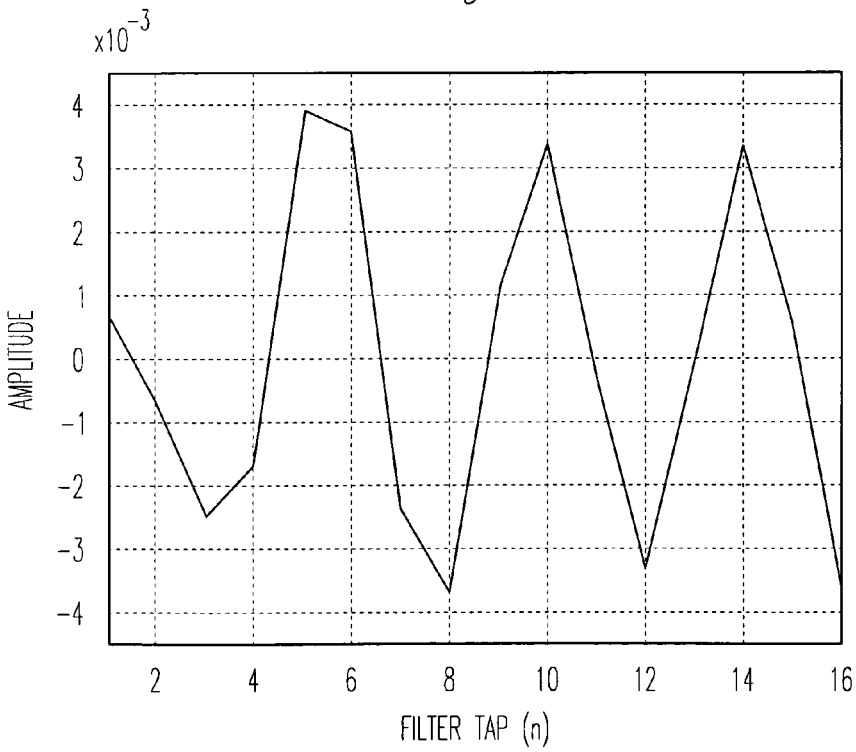
FIG. 10 is an example of an entrained feedback canceller filter profile, and in this case, due to a 3500 Hz tone input signal.

FIG. 10 is an example of an entrained feedback canceller filter profile, and in this case, due to a 3500 Hz tone input signal. The filter no longer represents the acoustic feedback path accurately and acquires the characteristics of the input signal. This profile exhibits high power in the back coefficients almost comparable to the center coefficient power. This increase in the back power is detected by the back power estimate to the center estimate rule and the entrained filter is reset to the good filter.

Figure 11:
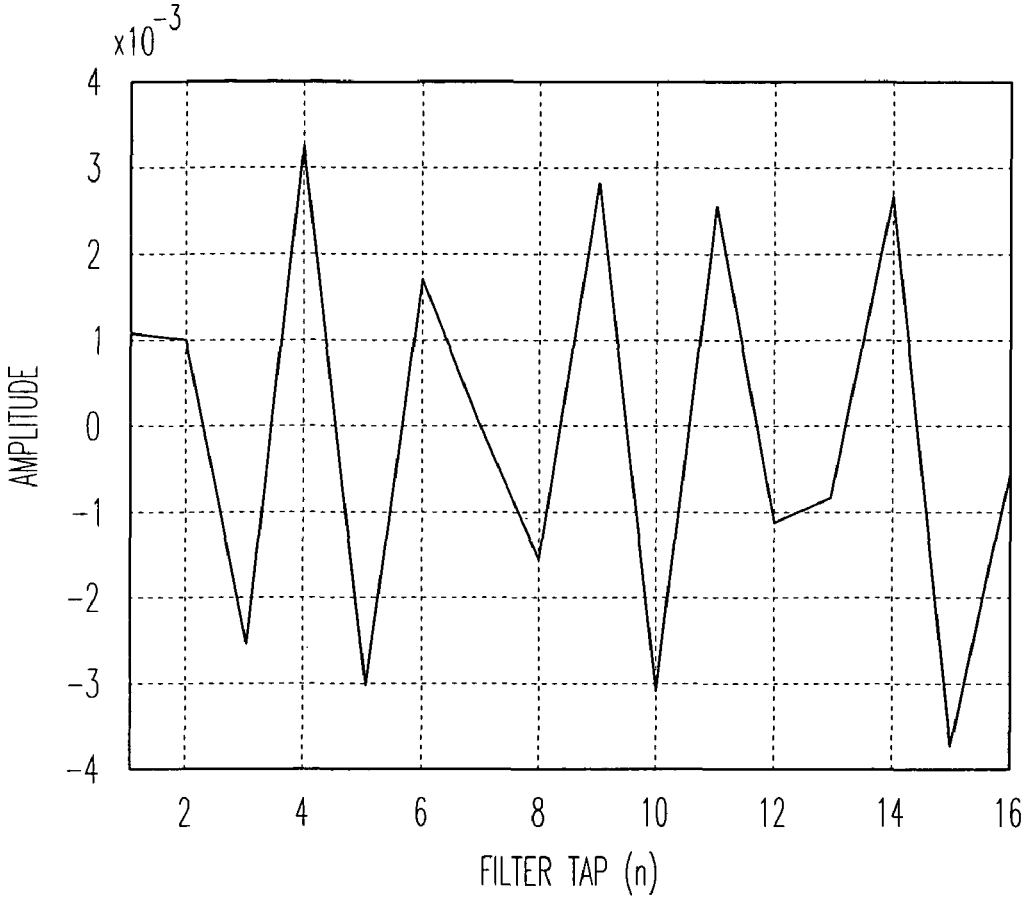
FIG. 11 is an example of an entrained feedback canceller filter profile, and in this case, due to a 6500 Hz tone input signal.

FIG. 11 is an example of an entrained feedback canceller filter profile, and in this case, due to a 6500 Hz tone input signal. The filter no longer represents the acoustic feedback path accurately and acquires the characteristics of the input signal. This profile exhibits a large number of slope transitions. In this example, the number of positive peaks and negative valleys are 11. This character is detected by the slope transition rule and the entrained filter is reset to the good filter.

Another alternative embodiment is the use of an initialization filter to use as a backup "good" filter. One way to accomplish the initialization filter design is to have the device produce white noise to an open loop configuration, derive filter coefficients from adapting to the white noise in an open loop configuration, and store these coefficients in an EEPROM to have as a backup "good" LTA Filter in case the LTA Filter becomes entrained. This technique can also be used as a best estimate to replace the active filter.

Another approach is to use a filter with more taps to detect entrainment better. An increase in taps provides an increase of separation between power in one region of filter coefficients to power in another region of filter coefficients. Regions can also be defined differently for longer filter lengths.

It is noted that the number of taps is adjustable without departing from the present subject matter. One advantage of changing the number of taps is to provide increased separation in measurements of power in different filter tap regions.

Although the present system is discussed in terms of hearing aids, it is understood that many other applications in other hearing assistance systems are possible. It is to be understood that the above description is intended to be illustrative, and not restrictive. Other embodiments will be apparent to those of skill in the art upon reviewing and understanding the above description. The scope of the invention should, therefore, be determined with reference to the appended claims, along with the full scope of equivalents to which such claims are entitled.

What is claimed is:

1. A method, comprising:

monitoring at least one feedback canceller filter characteristic indicative of entrainment of a feedback canceller filter, the feedback canceller filter including an active filter; and upon indication of entrainment, setting coefficients of the active filter to coefficients of another filter that approximates an acoustic path and that is without characteristics indicative of entrainment, and inhibiting an update of the active filter.

2. The method of claim 1, wherein the monitoring at least one feedback canceller filter characteristic includes monitoring a DC bias measure of a plurality of filter coefficients.

3. The method of claim 1, wherein the monitoring at least one feedback canceller filter characteristic includes monitoring a ratio of an end-coefficient power estimate with a center-coefficient power estimate of a plurality of filter coefficients.

4. The method of claim 1, wherein the monitoring at least one feedback canceller filter characteristic includes monitoring a number of slope transitions of a plurality of filter coefficients.

5. The method of claim 1, wherein the monitoring at least one feedback canceller filter characteristic includes monitoring a correlation estimate of a plurality of filter coefficients.

6. The method of claim 1, wherein the monitoring at least one feedback canceller filter characteristic includes monitoring a DC bias measure, a ratio of the end-coefficient power estimate to a center-coefficient power estimate, and a number of slope transitions of a plurality of filter coefficients.

7. The method of claim 1, wherein the active filter is reset to a long term average filter.

8. The method of claim 1, wherein the monitoring includes monitoring a long term average filter for entrainment.

9. The method of claim 1, comprising:

calculating a correlation coefficient between an input signal and the feedback canceller filter; and comparing the correlation coefficient to a pre-determined threshold, wherein if the correlation coefficient is greater than the pre-determined threshold, then the filter is detected as being entrained.

10. The method of claim 1, wherein the active filter is reset to an initialization filter.

11. An apparatus comprising: a microphone; signal processing electronics configured to process signals received from the microphone, the signal processing electronics including an adaptive filter and providing an estimate of an acoustic feedback for feedback cancellation; and a receiver adapted for emitting sound based on the processed signals, wherein the signal processing electronics is adapted for detection of entrainment of the adaptive filter, if entrainment is detected, to replace the filter coefficients with new filter coefficients that approximate an acoustic path and that is without characteristics indicative of entrainment.

12. The apparatus of claim 11, wherein the signal processing electronics is adapted for monitoring a DC bias measure of a plurality of filter coefficients.

13. The apparatus of claim 11, wherein the signal processing electronics is adapted for monitoring a ratio of an end-coefficient power estimate with a center-coefficient power estimate of a plurality of filter coefficients.

14. The apparatus of claim 11, wherein the signal processing electronics is adapted for monitoring a number of slope transitions of a plurality of filter coefficients.

15. The apparatus of claim 11, wherein the signal processing electronics is adapted for monitoring a correlation estimate of a plurality of filter coefficients.

16. The apparatus of claim 11, wherein the signal processing electronics is adapted for monitoring a DC bias measure, a ratio of the end-coefficient power estimate to a center-coefficient power estimate, and a number of slope transitions of a plurality of filter coefficients.

17. The apparatus of claim 11, wherein the signal processing electronics is adapted for updating a long term average when an indication of entrainment is not detected.

18. The apparatus of claim 11, wherein the adaptive filter includes an active filter and long term average filter.

19. The apparatus of claim 11, wherein the signal processing electronics includes amplification, G, and other signal processing electronics for hearing assistance devices.

20. A method, comprising: monitoring filter coefficients of an adaptive filter of a hearing assistance device for signs of entrainment of the adaptive filter; if entrainment is not detected, updating a long term average of the filter coefficients; and if entrainment is detected, replacing the filter coefficients with new filter coefficients that approximate an acoustic path and that is without characteristics indicative of entrainment.

21. The method of claim 20, wherein the monitoring includes monitoring coefficients of an active filter and monitoring coefficients of a long term filter.

22. The method of claim 21, wherein the monitoring incorporates a plurality of timing loops with individually adjustable parameters for monitoring the active filter and for monitoring the long term filter.

* * * * *